US009626983B2

(12) United States Patent
Atti et al.

(10) Patent No.: US 9,626,983 B2
(45) Date of Patent: Apr. 18, 2017

(54) TEMPORAL GAIN ADJUSTMENT BASED ON HIGH-BAND SIGNAL CHARACTERISTIC

(71) Applicant: QUALCOMM Incorporated, San Diego, CA (US)

(72) Inventors: Venkatraman S. Atti, San Diego, CA (US); Venkatesh Krishnan, San Diego, CA (US); Vivek Rajendran, San Diego, CA (US); Venkata Subrahmanyam Chandra Sekhar Chebiyyam, San Diego, CA (US); Subasingha Shaminda Subasingha, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/731,276

(22) Filed: Jun. 4, 2015

(65) Prior Publication Data

US 2015/0380007 A1 Dec. 31, 2015

Related U.S. Application Data

(60) Provisional application No. 62/017,790, filed on Jun. 26, 2014.

(51) Int. Cl.
*G10L 19/12* (2013.01)
*G10L 19/032* (2013.01)
(Continued)

(52) U.S. Cl.
CPC ..... *G10L 19/12* (2013.01); *G10L 19/032* (2013.01); *G10L 19/06* (2013.01);
(Continued)

(58) Field of Classification Search
CPC ..... G10L 19/12; G10L 19/032; G10L 19/06; G10L 21/038; G10L 21/0224;
(Continued)

(56) References Cited

U.S. PATENT DOCUMENTS 4,301,329 A 11/1981 Taguchi
5,142,581 A 8/1992 Tokuda et al.
(Continued)

FOREIGN PATENT DOCUMENTS

EP 0582921 A2 2/1994
GB 2318029 A * 4/1998 ..... G10L 19/06

OTHER PUBLICATIONS

International Search Report and Written Opinion of the International Searching Authority (EPO) for International Application No. PCT/US2015/034540, mailed Jul. 20, 2015, 13 pages.
(Continued)

*Primary Examiner* — Tammy Paige Goddard
*Assistant Examiner* — Edwin S Leland, III
(74) *Attorney, Agent, or Firm* — Toler Law Group, PC

(57) ABSTRACT

The present disclosure provides techniques for adjusting a temporal gain parameter and for adjusting linear prediction coefficients. A value of the temporal gain parameter may be based on a comparison of a synthesized high-band portion of an audio signal to a high-band portion of the audio signal. If a signal characteristic of an upper frequency range of the high-band portion satisfies a first threshold, the temporal gain parameter may be adjusted. A linear prediction (LP) gain may be determined based on an LP gain operation that uses a first value for an LP order. The LP gain may be associated with an energy level of an LP synthesis filter. The LP order may be reduced if the LP gain satisfies a second threshold.

19 Claims, 8 Drawing Sheets

(51) Int. Cl.

| | |
|---|---|
| ***G10L 19/06*** | (2013.01) |
| ***G10L 21/0224*** | (2013.01) |
| ***G10L 25/12*** | (2013.01) |
| ***G10L 21/038*** | (2013.01) |
| *G10L 19/00* | (2013.01) |
| *G10L 19/24* | (2013.01) |
| *G10L 19/02* | (2013.01) |

(52) U.S. Cl.
CPC ..... *G10L 21/0224* (2013.01); *G10L 21/038* (2013.01); *G10L 25/12* (2013.01); *G10L 19/0204* (2013.01); *G10L 19/24* (2013.01); *G10L 2019/0016* (2013.01)

(58) Field of Classification Search
CPC . G10L 25/12; G10L 2019/0016; G10L 19/24; G10L 19/0204
USPC ..... 704/205, 219
See application file for complete search history.

(56) References Cited

U.S. PATENT DOCUMENTS 6,636,829 B1 * 10/2003 Benyassine ..... G10L 19/005 704/201
6,782,360 B1 * 8/2004 Gao ..... G10L 19/083 704/219
7,146,309 B1 * 12/2006 Benyassine ..... G10L 19/08 704/201
8,140,331 B2 * 3/2012 Lou ..... G11B 27/28 704/205
2005/0004793 A1 1/2005 Ojala et al.
2006/0239473 A1 * 10/2006 Kjorling ..... H04S 5/005 381/98
2006/0277038 A1 * 12/2006 Vos ..... G10L 19/0208 704/219
2006/0282262 A1 * 12/2006 Vos ..... G10L 19/0208 704/219
2008/0010062 A1 * 1/2008 Son ..... G10L 19/20 704/219
2008/0027711 A1 * 1/2008 Rajendran ..... G10L 19/167 704/201
2010/0223054 A1 * 9/2010 Nemer ..... H04R 3/007 704/219
2010/0262420 A1 * 10/2010 Herre ..... G10L 19/20 704/201
2012/0250882 A1 * 10/2012 Mohammad ..... H04B 3/234 381/94.1
2013/0103408 A1 * 4/2013 Philippe ..... G10L 19/06 704/500
2015/0380006 A1 * 12/2015 Atti ..... G10L 19/032 704/205

OTHER PUBLICATIONS

Kabal P. et al., "Joint Optimization of Linear Predictors in Speech Coders," IEEE Transactions on Acoustics, Speech and Signal Processing, New York, USA, vol. 37, No. 5, May 1, 1989, pp. 642-650.
Ojala P. et al., "Variable Model Order LPC Quantization," Proceedings of the 1998 IEEE International Conference on Acoustics, Speech and Signal Processing, Seattle, WA, vol. 1, May 12-15, 1998, pp. 49-52.

* cited by examiner

TEMPORAL GAIN ADJUSTMENT BASED ON HIGH-BAND SIGNAL CHARACTERISTIC

I. CLAIM OF PRIORITY

The present application claims priority from U.S. Provisional Patent Application No. 62/017,790 entitled "TEMPORAL GAIN ADJUSTMENT BASED ON HIGH-BAND SIGNAL CHARACTERISTIC," filed Jun. 26, 2014, the contents of which are incorporated by reference in their entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Transmission of voice by digital techniques is widespread, particularly in long distance and digital radio telephone applications. There may be an interest in determining the least amount of information that can be sent over a channel while maintaining a perceived quality of reconstructed speech. If speech is transmitted by sampling and digitizing, a data rate on the order of sixty-four kilobits per second (kbps) may be used to achieve a speech quality of an analog telephone. Through the use of speech analysis, followed by coding, transmission, and re-synthesis at a receiver, a significant reduction in the data rate may be achieved.

Devices for compressing speech may find use in many fields of telecommunications. An exemplary field is wireless communications. The field of wireless communications has many applications including, e.g., cordless telephones, paging, wireless local loops, wireless telephony such as cellular and personal communication service (PCS) telephone systems, mobile Internet Protocol (IP) telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems.

The IS-95 standard subsequently evolved into "3G" systems, such as cdma2000 and WCDMA, which provide more capacity and high speed packet data services. Two variations of cdma2000 are presented by the documents IS-2000 (cdma2000 1×RTT) and IS-856 (cdma2000 1×EV-DO), which are issued by TIA. The cdma2000 1×RTT communication system offers a peak data rate of 153 kbps whereas the cdma2000 1×EV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may comprise an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, one frame length is twenty milliseconds, which corresponds to 160 samples at a sampling rate of eight kilohertz (kHz), although any frame length or sampling rate deemed suitable for the particular application may be used.

The encoder analyzes the incoming speech frame to extract certain relevant parameters, and then quantizes the parameters into binary representation, e.g., to a set of bits or a binary data packet. The data packets are transmitted over a communication channel (i.e., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits Ni and a data packet produced by the speech coder has a number of bits No, the compression factor achieved by the speech coder is Cr=Ni/No. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of No bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Predictive (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, No, for each frame) or at a variable rate (in which different bit rates are used for different types of frame contents). Variable-rate coders attempt to use the amount of bits needed to encode the codec parameters to a level adequate to obtain a target quality.

Time-domain coders such as the CELP coder may rely upon a high number of bits, NO, per frame to preserve the accuracy of the time-domain speech waveform. Such coders may deliver excellent voice quality provided that the number of bits, No, per frame is relatively large (e.g., 8 kbps or above). At low bit rates (e.g., 4 kbps and below), time-domain coders may fail to retain high quality and robust performance due to the limited number of available bits. At low bit rates, the limited codebook space clips the waveform-matching capability of time-domain coders, which are deployed in higher-rate commercial applications. Hence, despite improvements over time, many CELP coding systems operating at low bit rates suffer from perceptually significant distortion characterized as noise.

An alternative to CELP coders at low bit rates is the "Noise Excited Linear Predictive" (NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

There may be research interest and commercial interest in improving audio quality of a speech signal (e.g., a coded speech signal, a reconstructed speech signal, or both). For example, a communication device may receive a speech signal with lower than optimal voice quality. To illustrate, the communication device may receive the speech signal from another communication device during a voice call. The voice call quality may suffer due to various reasons, such as environmental noise (e.g., wind, street noise), limitations of the interfaces of the communication devices, signal processing by the communication devices, packet loss, bandwidth limitations, bit-rate limitations, etc.

In traditional telephone systems (e.g., public switched telephone networks (PSTNs)), signal bandwidth is limited to the frequency range of 300 Hertz (Hz) to 3.4 kilohertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 0 Hz to 6.4 kHz, also called the "low-band"). For example, the low-band may be represented using filter parameters and/or a low-band excitation signal. However, in order to improve coding efficiency, the higher frequency portion of the signal (e.g., 6.4 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. When encoding and decoding a high-band signal using signal modeling, unwanted noise or audible artifacts may be introduced into the high-band signal under certain conditions.

IV. SUMMARY

In a particular aspect, a method includes determining, at an encoder, whether a signal characteristic of an upper frequency range of a high-band portion of an input audio signal satisfies a threshold. The method also includes generating a high-band excitation signal corresponding to the high-band portion, generating a synthesized high-band portion based on the high-band excitation signal, and determining a value of a temporal gain parameter based on a comparison of the synthesized high-band portion to the high-band portion. The method further includes, responsive to the signal characteristic satisfying the threshold, adjusting the value of the temporal gain parameter. Adjusting the value of the temporal gain parameter controls a variability of the temporal gain parameter.

In another particular aspect, an apparatus includes a pre-processing module configured to filter at least a portion of an input audio signal to generate a plurality of outputs. The apparatus also includes a first filter configured to determine a signal characteristic of an upper frequency range of a high-band portion of the input audio signal. The apparatus further includes a high-band excitation generator configured to generate a high-band excitation signal corresponding to the high-band portion and a second filter configured to generate a synthesized high-band portion based on the high-band excitation signal. The apparatus includes a temporal envelope estimator configured to determine a value of a temporal gain parameter based on a comparison of the synthesized high-band portion to the high-band portion and, responsive to the signal characteristic satisfying a threshold, adjust the value of the temporal gain parameter. Adjusting the value of the temporal gain parameter controls a variability of the temporal gain parameter.

In another particular aspect, a non-transitory processor-readable medium includes instructions that, when executed by a processor, cause the processor to perform operations including determining whether a signal characteristic of an upper frequency range of a high-band portion of an input audio signal satisfies a threshold. The operations also include generating a high-band excitation signal corresponding to the high-band portion, generating a synthesized high-band portion based on the high-band excitation signal, and determining a value of a temporal gain parameter based on a comparison of the synthesized high-band portion to the high-band portion. The operations further include, responsive to the signal characteristic satisfying the threshold, adjusting the value of the temporal gain parameter. Adjusting the value of the temporal gain parameter controls a variability of the temporal gain parameter.

In another particular aspect, an apparatus includes means for filtering at least a portion of an input audio signal to generate a plurality of outputs. The apparatus also includes means for determining, based on the plurality of outputs, whether a signal characteristic of an upper frequency range of a high-band portion of the input audio signal satisfies a threshold. The apparatus further includes means for generating a high-band excitation signal corresponding to the high-band portion, means for synthesizing a synthesized high-band portion based on the high-band excitation signal, and means for estimating a temporal envelope of the high-band portion. The means for estimating is configured to determine a value of a temporal gain parameter based on a comparison of the synthesized high-band portion to the high-band portion, and, responsive to the signal characteristic satisfying the threshold, to adjust the value of the temporal gain parameter. Adjusting the value of the temporal gain parameter controls a variability of the temporal gain parameter.

In another particular aspect, a method of adjusting linear prediction coefficients (LPCs) of an encoder includes determining, at the encoder, a linear prediction (LP) gain based on an LP gain operation that uses a first value for an LP order. The LP gain is associated with an energy level of an LP synthesis filter. The method also includes comparing the LP gain to a threshold and reducing the LP order from the first value to a second value if the LP gain satisfies the threshold.

In another particular aspect, an apparatus includes an encoder and a memory storing instructions that are executable by the encoder to perform operations. The operations include determining a linear prediction (LP) gain based on an LP gain operation that uses a first value for an LP order. The LP gain is associated with an energy level of an LP synthesis filter. The operations also include comparing the LP gain to a threshold and reducing the LP order from the first value to a second value if the LP gain satisfies the threshold.

In another particular aspect, a non-transitory computer-readable medium includes instructions for adjusting linear prediction coefficients (LPCs) of an encoder. The instructions, when executed by the encoder, cause the encoder to perform operations. The operations include determining a linear prediction (LP) gain based on an LP gain operation that uses a first value for an LP order. The LP gain is associated with an energy level of an LP synthesis filter. The operations also include comparing the LP gain to a threshold and reducing the LP order from the first value to a second value if the LP gain satisfies the threshold.

In another particular aspect, an apparatus includes means for determining a linear prediction (LP) gain based on an LP gain operation that uses a first value for an LP order. The LP gain is associated with an energy level of an LP synthesis filter. The apparatus also includes means for comparing the LP gain to a threshold and means for reducing the LP order from the first value to a second value if the LP gain satisfies the threshold.

V. BRIEF DESCRIPTION OF THE DRAWINGS

Figure 3:
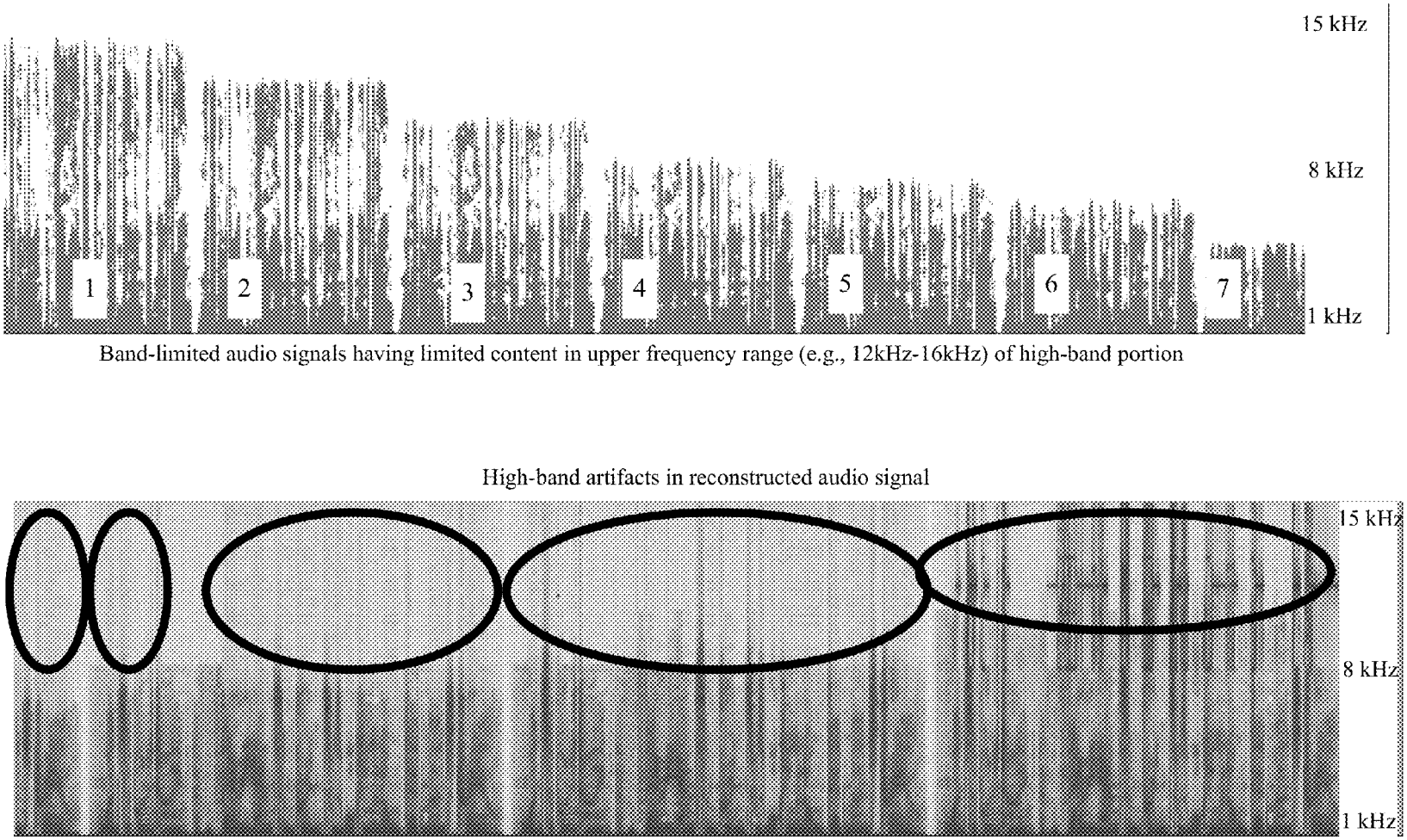
Figure 4:
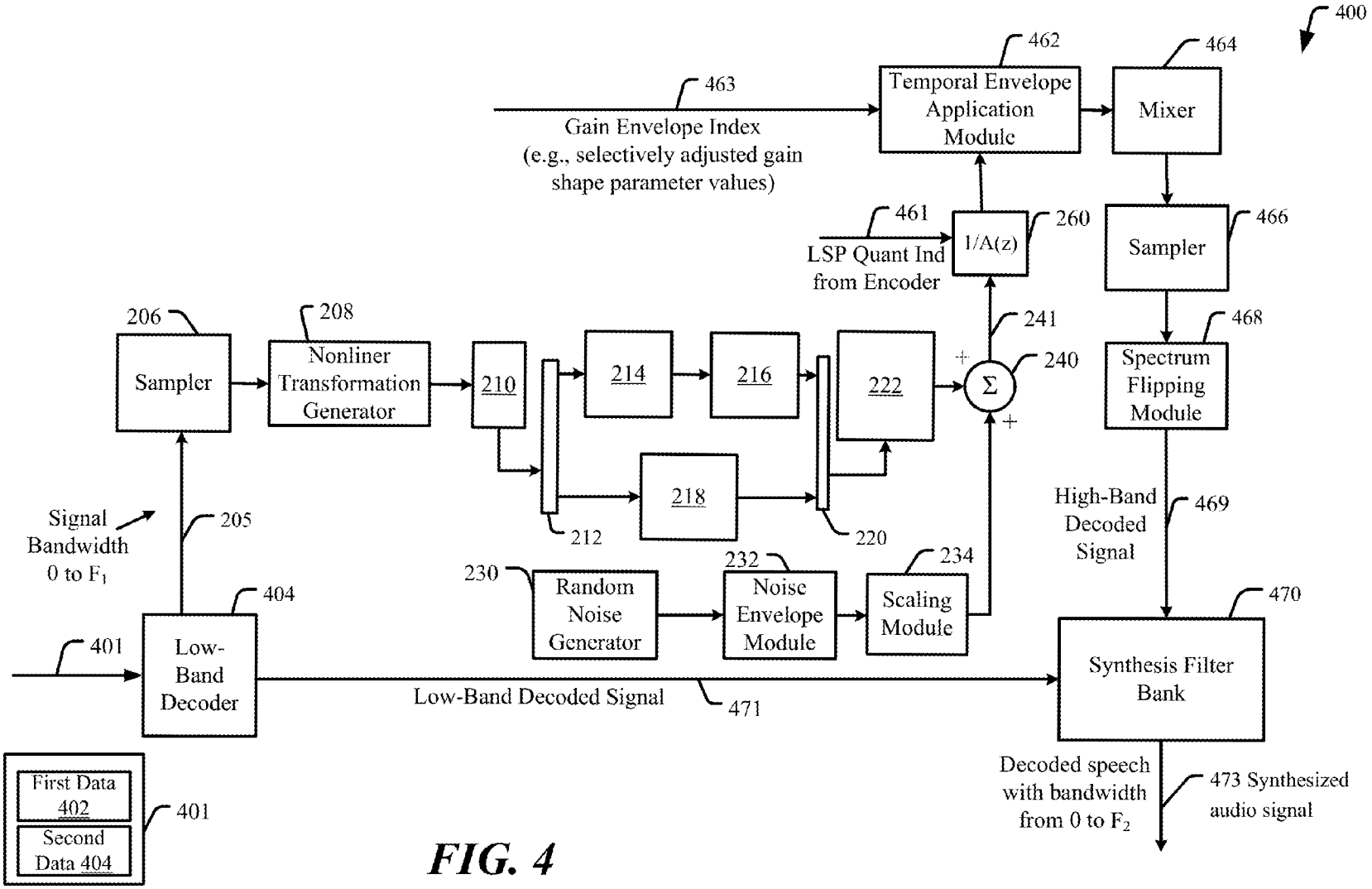
Figure 5A:
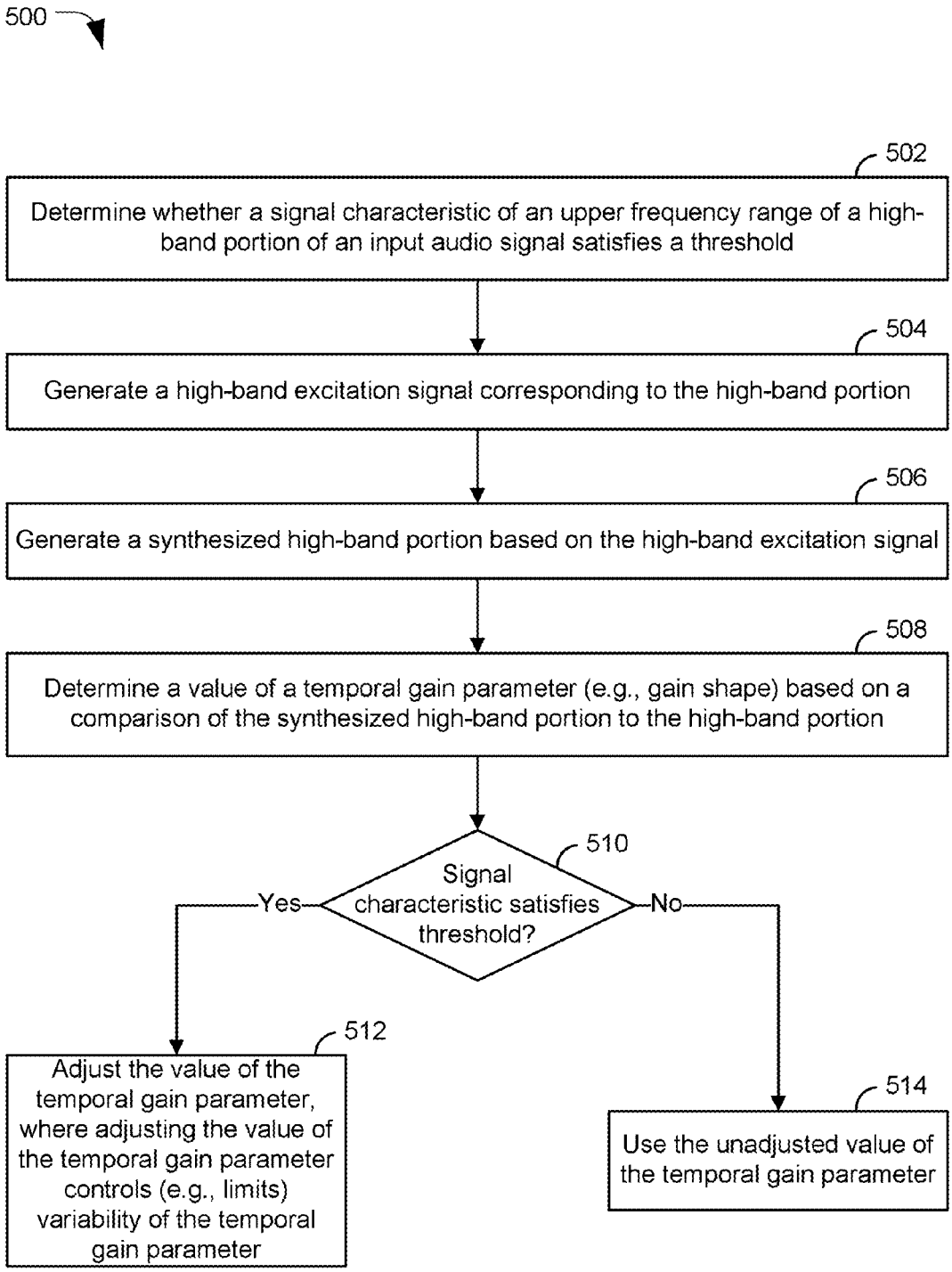
Figure 5B:
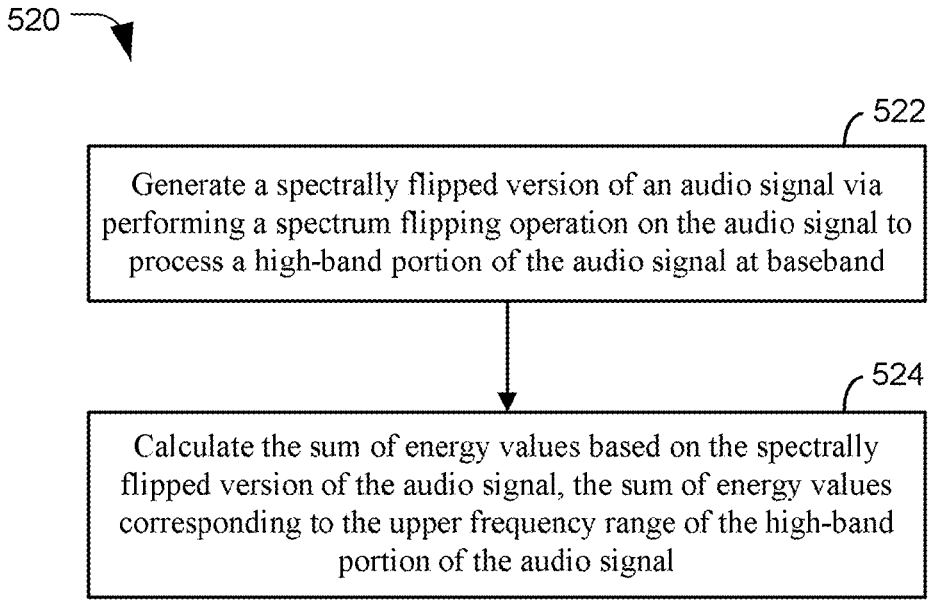
Figure 5C:
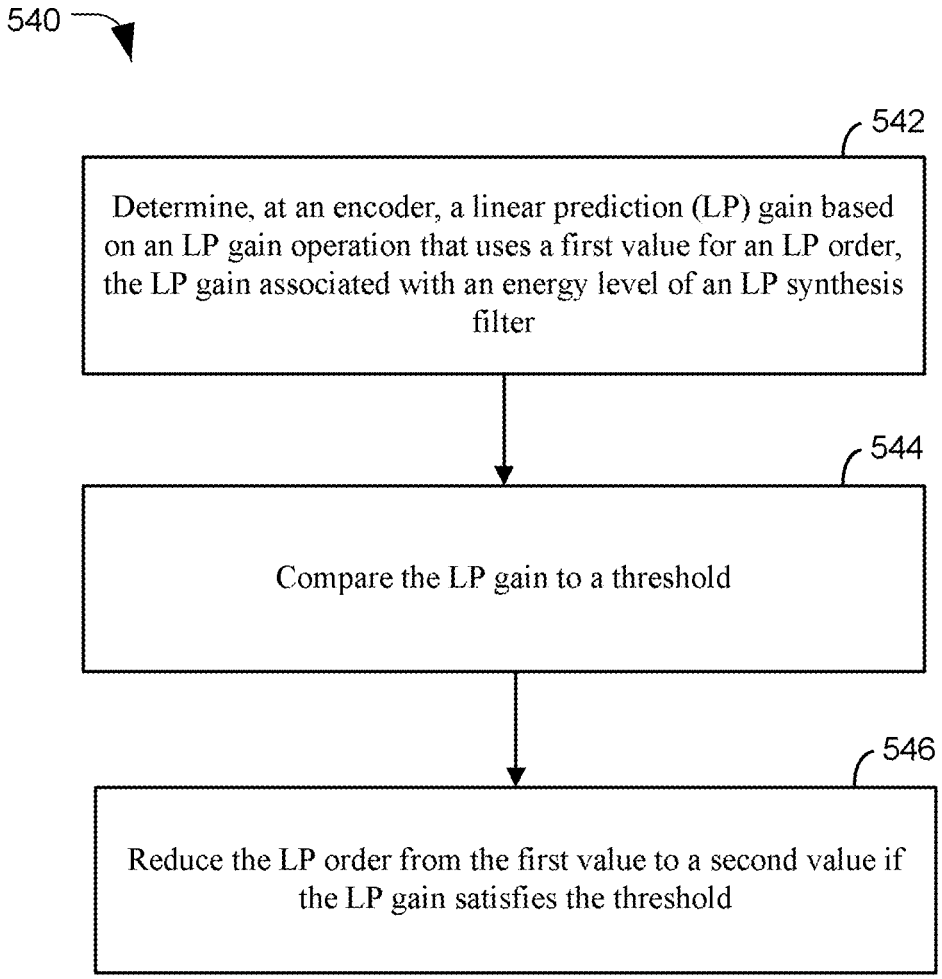
Figure 6:
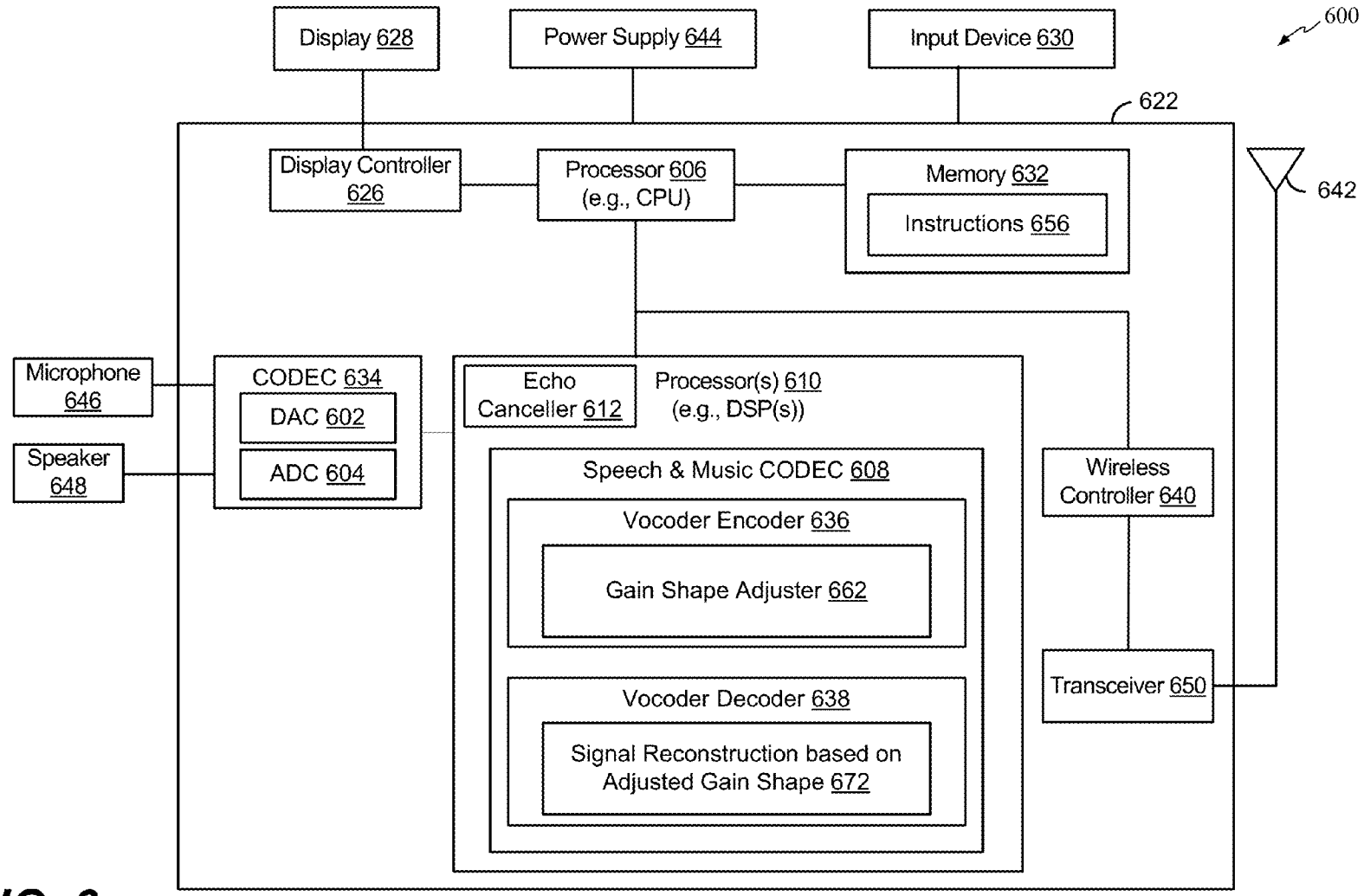

FIG. 3 includes diagrams illustrating frequency components of signals according to a particular aspect;

FIG. 4 is a diagram to illustrate a particular aspect of components of a decoder operable to synthesize a high-band portion of an audio signal using temporal gain parameters that are adjusted based on a high-band signal characteristic;

FIG. 5A depicts a flowchart to illustrate a particular aspect of a method of adjusting a temporal gain parameter based on a high-band signal characteristic;

FIG. 5B depicts a flowchart to illustrate a particular aspect of a method of calculating a high-band signal characteristic;

FIG. 5C depicts a flowchart to illustrate a particular aspect of method of adjusting linear prediction coefficients (LPCs) of an encoder; and FIG. 6 is a block diagram of a wireless device operable to perform signal processing operations in accordance with the systems, apparatuses, and methods of FIGS. 1-5B.

VI. DETAILED DESCRIPTION

Systems and methods of adjusting temporal gain information based on a high-band signal characteristic are disclosed. For example, the temporal gain information may include a gain shape parameter that is generated at an encoder on a per-sub-frame basis. In certain situations, an audio signal input into the encoder may have little or no content in the high-band (e.g., may be "band-limited" with regards to the high-band). For example, a band-limited signal may be generated during audio capture at an electronic device that is compatible with the SWB model, a device that is not capable of capturing data across an entirety of the high-band, etc. To illustrate, a particular wireless telephone may not be capable, or may be programmed to refrain from capturing, data at frequencies higher than 8 kHz, higher 10 kHz, etc. When encoding such band-limited signals, a signal model (e.g., a SWB harmonic model) may introduce audible artifacts due to a large variation in temporal gain.

To reduce such artifacts, an encoder (e.g., a speech encoder or "vocoder") may determine a signal characteristic of an audio signal that is to be encoded. In one example, the signal characteristic is a sum of energies in an upper frequency region of the high-band portion of the audio signal. As a non-limiting example, the signal characteristic may be determined by summing energies of analysis filter bank outputs in a 12 kHz-16 kHz frequency range, and may thus correspond to a high-band "signal floor." As used herein, the "upper frequency region" of the high-band portion of the audio signal may correspond to any frequency range (at the upper portion of high-band portion of the audio signal) that is less than the bandwidth of the high-band portion of the audio signal. As a non-limiting example, if the high-band portion of the audio signal is characterized by a 6.4 kHz-14.4 kHz frequency range, the upper frequency region of the high-band portion of the audio signal may be characterized by a 10.6 kHz-14.4 kHz frequency range. As another non-limiting example, if the high-band portion of the audio signal is characterized by a 8 kHz-16 kHz frequency range, the upper frequency region of the high-band portion of the audio signal may be characterized by a 13 kHz-16 kHz frequency range. The encoder may process the high-band portion of the audio signal to generate a high-band excitation signal and may generate a synthesized version of the high-band portion based on the high-band excitation signal. Based on a comparison of the "original" and synthesized high-band portions, the encoder may determine a value of a gain shape parameter. If the signal characteristic of the high-band portion satisfies a threshold (e.g., the signal characteristic indicates that the audio signal is band-limited and has little or no high-band content), the encoder may adjust the value of the gain shape parameter to limit variability (e.g., a limited dynamic range) of the gain shape parameter. Limiting the variability of the gain shape parameter may reduce artifacts generated during encoding/decoding of the band-limited audio signal.

Figure 1:
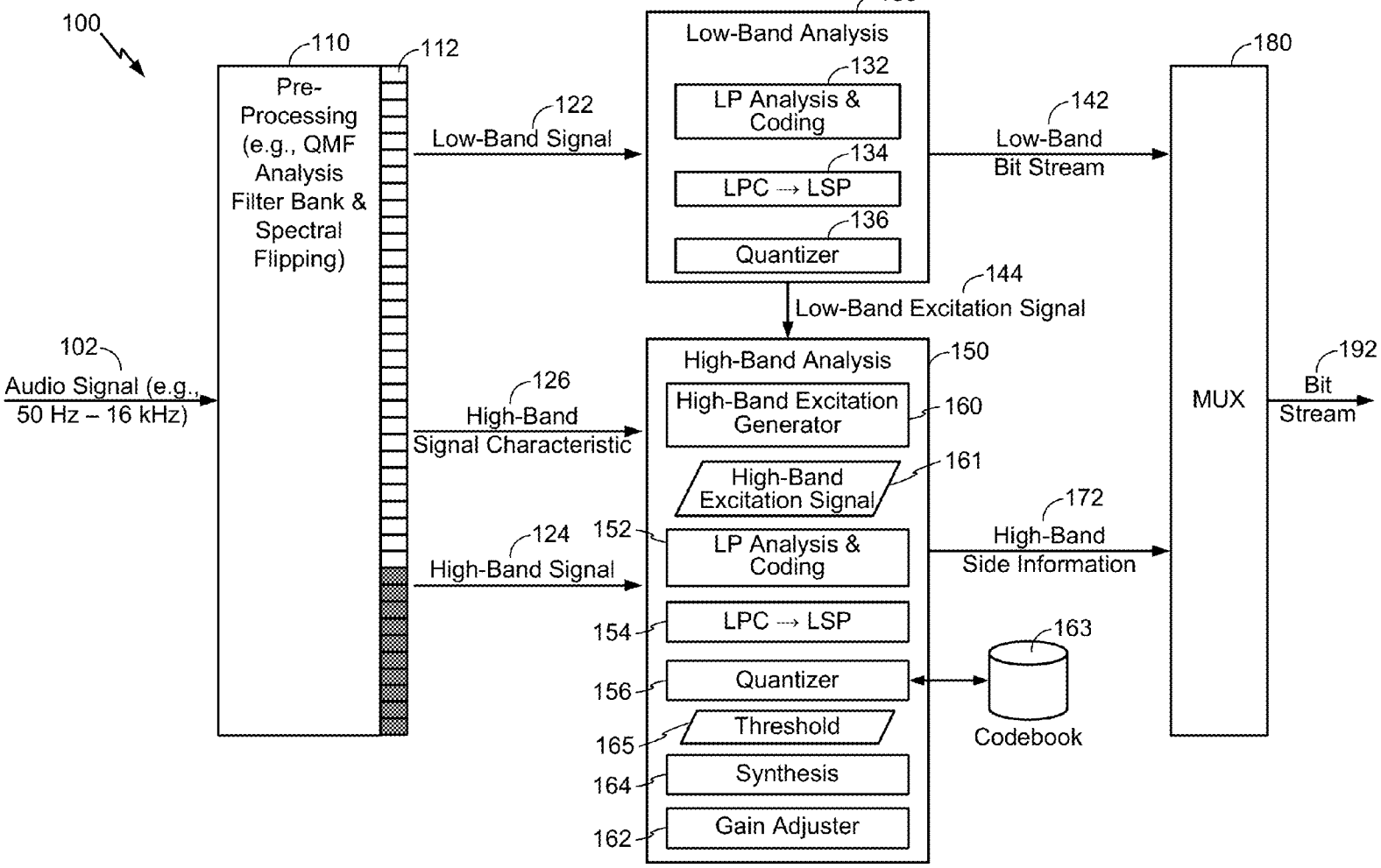
FIG. 1 is a diagram to illustrate a particular aspect of a system that is operable to adjust a temporal gain parameter based on a high-band signal characteristic.

Referring to FIG. 1, a particular aspect of a system that is operable to adjust a temporal gain parameter based on a high-band signal characteristic is shown and generally designated 100. In a particular aspect, the system 100 may be integrated into an encoding system or apparatus (e.g., in a wireless telephone or coder/decoder (CODEC)).

It should be noted that in the following description, various functions performed by the system 100 of FIG. 1 are described as being performed by certain components or modules. However, this division of components and modules is for illustration only. In an alternate aspect, a function performed by a particular component or module may instead be divided amongst multiple components or modules. Moreover, in an alternate aspect, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes a pre-processing module 110 that is configured to receive an audio signal 102. For example, the audio signal 102 may be provided by a microphone or other input device. In a particular aspect, the audio signal 102 may include speech. The audio signal 102 may be a super wideband (SWB) signal that includes data in the frequency range from approximately 50 hertz (Hz) to approximately 16 kilohertz (kHz). The pre-processing module 110 may filter the audio signal 102 into multiple portions based on frequency. For example, the pre-processing module 110 may generate a low-band signal 122 and a high-band signal 124. The low-band signal 122 and the high-band signal 124 may have equal or unequal bandwidths, and may be overlapping or non-overlapping.

In a particular aspect, the low-band signal 122 and the high-band signal 124 correspond to data in non-overlapping frequency bands. For example, the low-band signal 122 and the high-band signal 124 may correspond to data in non-overlapping frequency bands of 50 Hz-7 kHz and 7 kHz-16 kHz. In an alternate aspect, the low-band signal 122 and the high-band signal 124 may correspond to data non-overlapping frequency bands of 50 Hz-8 kHz and 8 kHz-16 kHz. In an another alternate aspect, the low-band signal 122 and the high-band signal 124 correspond to overlapping bands (e.g., 50 Hz-8 kHz and 7 kHz-16 kHz), which may enable a low-pass filter and a high-pass filter of the pre-processing module 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

In a particular aspect, the pre-processing module 110 includes an analysis filter bank. For example, the pre-processing module 110 may include a quadrature mirror filter (QMF) filter bank that includes a plurality of QMFs. Each QMF may filter a portion of the audio signal 102. As another example, the pre-processing module 110 may include a complex low delay filter bank (CLDFB). The pre-processing module 110 may also include a spectral flipper configured to flip a spectrum of the audio signal 102. Thus, in a particular aspect, although the high-band signal 124 corresponds to a high-band portion of the audio signal 102, the high-band signal 124 may be communicated as a baseband signal.

In a particular SWB aspect, the filter bank includes 40 QMF filters, where each QMF filter (e.g., an illustrative QMF filter 112) operates on a 400 Hz portion of the audio signal 102. Each QMF filter 112 may generate filter outputs that include a real part and an imaginary part. The pre-processing module 110 may sum filter outputs from QMF filters corresponding to an upper frequency portion of the high-band portion of the audio signal 102. For example, the pre-processing module 110 may sum outputs from the ten QMFs corresponding to the 12 kHz-16 kHz frequency range, which are shown in FIG. 1 using a shading pattern. The pre-processing module 110 may determine a high-band signal characteristic 126 based on the summed QMF outputs. In a particular aspect, the pre-processing module 110 performs a long-term averaging operation on the sum of QMF outputs to determine the high-band signal characteristic 126. To illustrate, the pre-processing module 110 may operate in accordance with the following pseudocode:

```
//CLDFB_NO_COL_MAX = 16;
//nB: number of bands
//ts: number of samples per band
//realBufferFlipped: QMF analysis filter output (real)
//imagBufferFlipped: QMF analysis filter output (imaginary)
//qmfHBLT: long-term average of high-band signal floor
//Estimate high-band signal floor
float QmfHB = 0;
/*iterate over ten bands = 10*400 Hz = 4 kHz corresponding to
12-16kHz data. QMFs 0-9 used because operating in flipped signal
domain, so upper frequencies of high-band processed by the lowest
number QMFs*/
for (nB = 0; nB < 10; nB++)
{
  for (ts = 0; ts < CLDFB_NO_COL_MAX; ts++) //iterate over
  samples in each band
  {
    /*sum the squares of real/imaginary buffer outputs (which
      correspond to magnitude/signal energy */
    QmfHB += (realBufferFlipped[ts][nB] * realBufferFlipped[ts][nB]) +
              (imagBufferFlipped[ts][nB] * imagBufferFlipped[ts][nB]);
  }
}
/* perform long-term averageing of high-band signal floor in log domain
0.221462 = 1/log10(32768) /*
qmfHBLT = 0.9 * qmfHBLT + 0.1 * (0.221462 * (log10(QmfHB) -
1.0));
```

Although the above pseudocode illustrates long-term averaging over ten bands (e.g., ten 400 Hz bands representing 12-16 kHz data) using QMF analysis filter banks, it should be appreciated that the pre-processing module 110 may operate in accordance with substantially similar pseudocode for different analysis filter banks, a different number of bands, and/or a different frequency range of data. As a non-limiting example, the pre-processing module 110 may utilize complex low delay analysis filter banks for 20 bands representing 13-16 kHz data.

In a particular aspect, the high-band signal characteristic 126 is determined on a per-sub-frame basis. To illustrate, the audio signal 102 may be divided into a plurality of frames, where each frame corresponds to approximately 20 milliseconds (ms) of audio. Each frame may include a plurality of sub-frames. For example, each 20 ms frame may include four 5 ms (or approximately 5 ms) sub-frames. In alternate aspects, frames and sub-frames may correspond to different lengths of time and a different number of sub-frames may be included in each frame.

It should be noted that although the example of FIG. 1 illustrates processing of a SWB signal, this is for illustration only. In an alternate aspect, the audio signal 102 may be a wideband (WB) signal having a frequency range of approximately 50 Hz to approximately 8 kHz. In such an aspect, the low-band signal 122 may correspond to a frequency range of approximately 50 Hz to approximately 6.4 kHz and the high-band signal 124 may correspond to a frequency range of approximately 6.4 kHz to approximately 8 kHz.

The system 100 may include a low-band analysis module 130 configured to receive the low-band signal 122. In a particular aspect, the low-band analysis module 130 may represent an aspect of a code excited linear prediction (CELP) encoder. The low-band analysis module 130 may include a linear prediction (LP) analysis and coding module 132, a linear prediction coefficient (LPC) to line spectral pair (LSP) transform module 134, and a quantizer 136. LSPs may also be referred to as line spectral frequencies (LSFs), and the two terms may be used interchangeably herein. The LP analysis and coding module 132 may encode a spectral envelope of the low-band signal 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular aspect, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 and the high-band signal characteristic 126 from the pre-processing module 110 and to receive the low-band excitation signal 144 from the low-band analysis module 130. The high-band analysis module 150 may generate high-band side information (e.g., parameters) 172. For example, the high-band side information 172 may include high-band LSPs, gain information, etc.

The high-band analysis module 150 may include a high-band excitation generator 160. The high-band excitation generator 160 may generate a high-band excitation signal 161 by extending a spectrum of the low-band excitation signal 144 into the high-band frequency range (e.g., 8 kHz-16 kHz). To illustrate, the high-band excitation generator 160 may apply a transform to the low-band excitation signal (e.g., a non-linear transform such as an absolute-value or square operation) and may mix the transformed low-band excitation signal with a noise signal (e.g., white noise modulated according to an envelope corresponding to the low-band excitation signal 144 that mimics slow varying temporal characteristics of the low-band signal 122) to generate the high-band excitation signal 161.

The high-band excitation signal 161 may be used to determine one or more high-band gain parameters that are included in the high-band side information 172. As illustrated, the high-band analysis module 150 may also include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). The LP analysis and coding module 152 may generate a set of LPCs that are transformed to LSPs by the transform module 154 and quantized by the quantizer 156 based on a codebook 163. For example, the LP analysis and coding module 152, the transform module 154, and the quantizer 156 may use the high-band signal 124 to determine high-band filter information (e.g., high-band LSPs) that is included in the high-band side information 172. In a particular aspect, the high-band analysis module 150 may include a local decoder that uses filter coefficients based on the LPCs generated by the transform module 154 and that receives the high-band excitation signal 161 as an input. An output of a synthesis filter (e.g., the synthesis module 164) of the local decoder, such as a synthesized version of the high-band signal 124, may be compared to the high-band signal 124 and gain parameters (e.g., a frame gain and/or temporal envelope gain shaping values) may be determined, quantized, and included in the high-band side information 172.

In a particular aspect, the high-band side information 172 may include high-band LSPs as well as high-band gain parameters. For example, the high-band side information 172 may include a temporal gain parameter (e.g., a gain shape parameter) that indicates how a spectral envelope of the high-band signal 124 evolves over time. For example, a gain shape parameter may be based on a ratio of normalized energy between an "original" high-band portion and a synthesized high-band portion. The gain shape parameter may be determined and applied on a per-sub-frame basis. In a particular aspect, a second gain parameter may also be determined and applied. For example, a "gain frame" parameter may be determined and applied across an entire frame, where the gain frame parameter corresponds to an energy ratio of high-band to low-band for the particular frame.

For example, the high-band analysis module 150 may include a synthesis module 164 configured to generate a synthesized version of the high-band signal 124 based on the high-band excitation signal 161. The high-band analysis module 150 may also include a gain adjuster 162 that determines a value of the gain shape parameter based on a comparison of the "original" high-band signal 124 and the synthesized version of the high-band signal generated by the synthesis module 164. To illustrate, for a particular frame of audio that includes four sub-frames, the high-band signal 124 may have values (e.g., amplitudes or energies) of 10, 20, 30, 20 for the respective sub-frames. The synthesized version of the high-band signal may have values 10, 10, 10, 10. The gain adjuster 162 may determine values of the gain shape parameter as 1, 2, 3, 2 for the respective sub-frames. At a decoder, the gain shape parameter values may be used to shape the synthesized version of the high-band signal to more closely reflect the "original" high-band signal 124. In a particular aspect, the gain adjuster 162 may normalize the gain shape parameter values to values between 0 and 1. For example, the gain shape parameter values may be normalized to 0.33, 0.67, 1, 0.33.

In a particular aspect, the gain adjuster 162 may adjust a value of the gain shape parameter based on whether the high-band signal characteristic 126 satisfies a threshold 165. The threshold 165 may be fixed or may be adjustable. The high-band signal characteristic 126 satisfying the threshold 165 may indicate that the audio signal 102 includes less than a threshold amount of audio content in the upper frequency region (e.g., 12 kHz-16 kHz) of the high-band portion (e.g., 8 kHz-16 kHz). Thus, the high-band signal characteristic may be determined in a filtering/analysis domain (e.g., a QMF domain), as opposed to a synthesized domain. When the audio signal 102 includes little or no content in the upper frequency region of the high-band portion, large swings in gain may be encoded by the high-band analysis module 150, causing audible artifacts on signal decoding. To reduce such artifacts, the gain adjuster 162 may adjust gain shape parameter value(s) when the high-band signal characteristic satisfies the threshold 165. Adjusting the gain shape parameter value(s) may limit a variability (e.g., dynamic range) of the gain shape parameter. To illustrate, the gain adjuster may operate in accordance with the following pseudocode:

```
/* NUM_SHB_SUBGAINS = number of gain shape values per
   frame = 4 limit gain shape dynamic range if long-term high-band
   signal floor is less than threshold (normalized threshold of 1.0 is used
   in this example) */
if (qmfHBLT < 1.0)
{
  for (i = 0; i < NUM_SHB_SUBGAINS; i++)
  {
    /*gain shape value for each sub frame is limited to a normalized
      constant +/- 10% of gain shape value */
    GainShape[i] = 0.315 + 0.1*GainShape[i];
  }
}
```

In an alternate aspect, the threshold 165 may be stored at or available to the pre-processing module 110, and the pre-processing module 110 may determine whether the high-band signal characteristic 126 satisfies the threshold 165. In this aspect, the pre-processing module 110 may send the gain adjuster 162 an indicator (e.g., a bit). The indicator may have a first value (e.g., 1) when the high-band signal characteristic 126 satisfies the threshold 165 and may have a second value (e.g., 0) when the high-band signal characteristic 126 does not satisfy the threshold 165. The gain adjuster 162 may adjust value(s) of the gain shape parameter based on whether the indicator has the first value or the second value.

The low-band bit stream 142 and the high-band side information 172 may be multiplexed by a multiplexer (MUX) 180 to generate an output bit stream 192. The output bit stream 192 may represent an encoded audio signal corresponding to the audio signal 102. For example, the output bit stream 192 may be transmitted (e.g., over a wired, wireless, or optical channel) and/or stored. At a receiver, reverse operations may be performed by a demultiplexer (DEMUX), a low-band decoder, a high-band decoder, and a filter bank to generate an audio signal (e.g., a reconstructed version of the audio signal 102 that is provided to a speaker or other output device). The number of bits used to represent the low-band bit stream 142 may be substantially larger than the number of bits used to represent the high-band side information 172. Thus, most of the bits in the output bit stream 192 may represent low-band data. The high-band side information 172 may be used at a receiver to regenerate the high-band excitation signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data.

Using the signal model, the high-band analysis module 150 at a transmitter may be able to generate the high-band side information 172 such that a corresponding high-band analysis module at a receiver is able to use the signal model to reconstruct the high-band signal 124 from the output bit stream 192.

By selectively adjusting temporal gain information (e.g., the gain shape parameter) when a high-band signal characteristic satisfies a threshold, the system 100 of FIG. 1 may reduce audible artifacts when a signal being encoded is band-limited (e.g., includes little or no high-band content). The system 100 of FIG. 1 may thus enable constraining temporal gain when an input signal does not adhere to a signal model in use.

Figure 2:
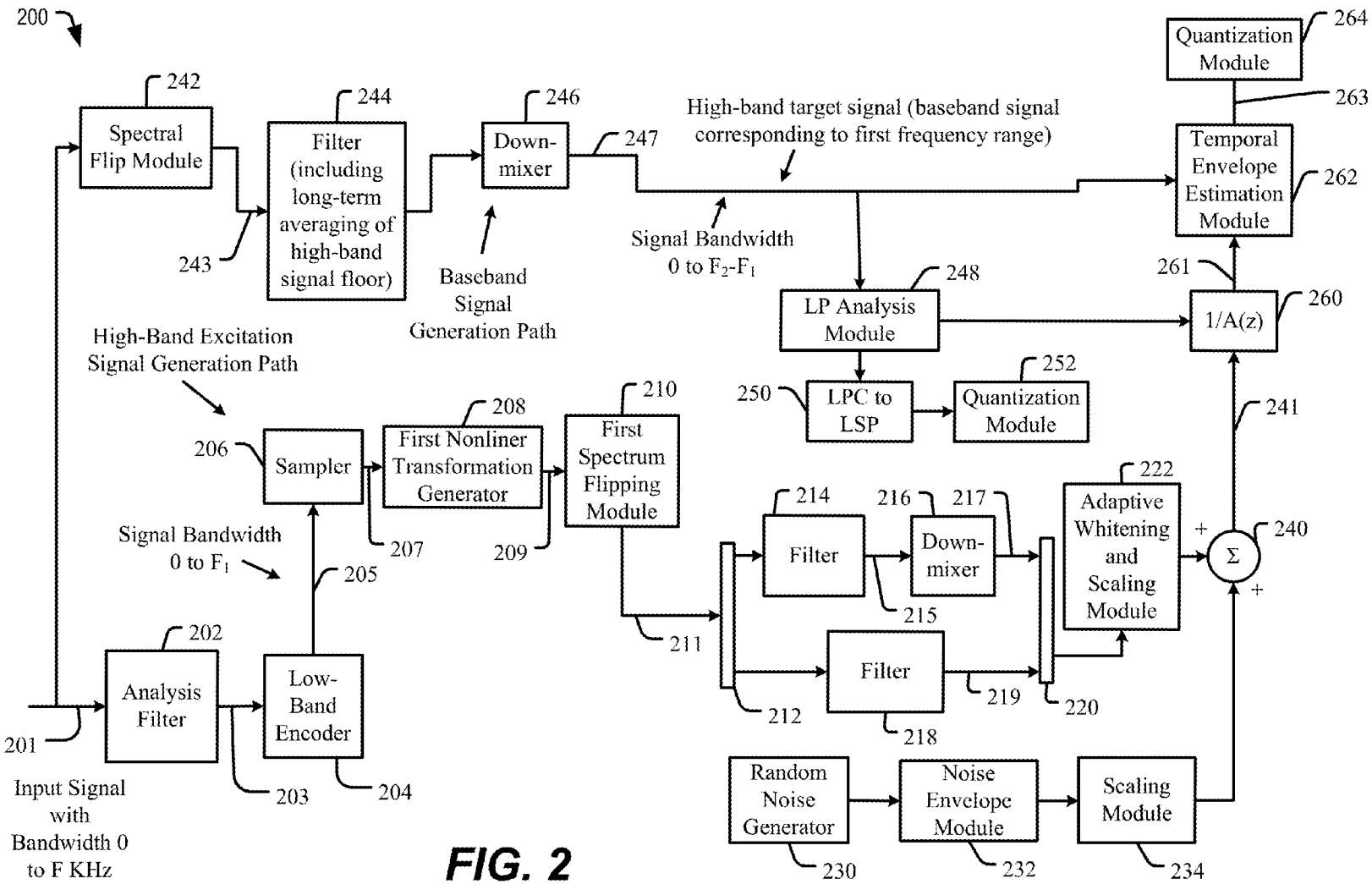
FIG. 2 is a diagram to illustrate a particular aspect of components of an encoder operable to adjust a temporal gain parameter based on a high-band signal characteristic.

Referring to FIG. 2, a particular aspect of components used in an encoder 200 is shown. In an illustrative aspect, the encoder 200 corresponds to the system 100 of FIG. 1.

An input signal 201 with bandwidth of "F" (e.g., a signal having a frequency range from 0 Hz-F Hz, such as 0 Hz-16 kHz when F=16,000=16 k) may be received by the encoder 200. An analysis filter 202 may output a low-band portion of the input signal 201. The signal 203 output from the analysis filter 202 may have frequency components from 0 Hz to F1 Hz (such as 0 Hz-6.4 kHz when F1=6.4 k).

A low-band encoder 204, such as an ACELP encoder (e.g., the LP analysis and coding module 132 in the low-band analysis module 130 of FIG. 1), may encode the signal 203. The ACELP encoder 204 may generate coding information, such as LPCs, and a low-band excitation signal 205.

The low-band excitation signal 205 from the ACELP encoder (which may also be reproduced by an ACELP decoder in a receiver, such as described in FIG. 4) may be upsampled at a sampler 206 so that the effective bandwidth of an upsampled signal 207 is in a frequency range from 0 Hz to F Hz. The low-band excitation signal 205 may be received by the sampler 206 as a set of samples correspond to a sampling rate of 12.8 kHz (e.g., the Nyquist sampling rate of a 6.4 kHz low-band excitation signal 205). For example, the low-band excitation signal 205 may be sampled at twice the rate of the bandwidth of the low-band excitation signal 205.

A first nonlinear transformation generator 208 may be configured to generate a bandwidth-extended signal 209, illustrated as a nonlinear excitation signal based on the upsampled signal 207. For example, the nonlinear transformation generator 208 may perform a nonlinear transformation operation (e.g., an absolute-value operation or a square operation) on the upsampled signal 207 to generate the bandwidth-extended signal 209. The nonlinear transformation operation may extend the harmonics of the original signal, the low-band excitation signal 205 from 0 Hz to F1 Hz (e.g., 0 Hz to 6.4 kHz), into a higher band, such as from 0 Hz to F Hz (e.g., from 0 Hz to 16 kHz).

The bandwidth-extended signal 209 may be provided to a first spectrum flipping module 210. The first spectrum flipping module 210 may be configured to perform a spectrum mirror operation (e.g., "flip" the spectrum) of the bandwidth-extended signal 209 to generate a "flipped" signal 211. Flipping the spectrum of the bandwidth-extended signal 209 may change (e.g., "flip") the contents of the bandwidth-extended signal 209 to opposite ends of the spectrum ranging from 0 Hz to F Hz (e.g., from 0 Hz to 16 kHz) of the flipped signal 211. For example, content at 14.4 kHz of the bandwidth-extended signal 209 may be at 1.6 kHz of the flipped signal 211, content at 0 Hz of the bandwidth-extended signal 209 may be at 16 kHz of the flipped signal 211, etc.

The flipped signal 211 may be provided to an input of a switch 212 that selectively routes the flipped signal 211 in a first mode of operation to a first path that includes a filter 214 and a downmixer 216, or in a second mode of operation to a second path that includes a filter 218. For example, the switch 212 may include a multiplexer responsive to a signal at a control input that indicates the operating mode of the encoder 200.

In the first mode of operation, the flipped signal 211 is bandpass filtered at the filter 214 to generate a bandpass signal 215 with reduced or removed signal content outside of the frequency range from (F−F2) Hz to (F−F1) Hz, where F2>F1. For example, when F=16 k, F1=6.4 k, and F2=14.4 k, the flipped signal 211 may be bandpass filtered to the frequency range 1.6 kHz to 9.6 kHz. The filter 214 may include a pole-zero filter configured to operate as a low-pass filter having a cutoff frequency at approximately F−F1 (e.g., at 16 kHz-6.4 kHz=9.6 kHz). For example, the pole-zero filter may be a high-order filter having a sharp drop-off at the cutoff frequency and configured to filter out high-frequency components of the flipped signal 211 (e.g., filter out components of the flipped signal 211 between (F−F1) and F, such as between 9.6 kHz and 16 kHz). In addition, the filter 214 may include a high-pass filter configured to attenuate frequency components in an output signal that are below F−F2 (e.g., below 16 kHz-14.4 kHz=1.6 kHz).

The bandpass signal 215 may be provided to the downmixer 216, which may generate a signal 217 having an effective signal bandwidth extending from 0 Hz to (F2−F1) Hz, such as from 0 Hz to 8 kHz. For example, the downmixer 216 may be configured to down-mix the bandpass signal 215 from the frequency range between 1.6 kHz and 9.6 kHz to baseband (e.g., a frequency range between 0 Hz and 8 kHz) to generate the signal 217. The downmixer 216 may be implemented using two-stage Hilbert transforms. For example, the downmixer 216 may be implemented using two fifth-order infinite impulse response (IIR) filters having imaginary and real components.

In the second mode of operation, the switch 212 provides the flipped signal 211 to the filter 218 to generate a signal 219. The filter 218 may operate as a low pass filter to attenuate frequency components above (F2−F1) Hz (e.g., above 8 kHz). The low pass filtering at the filter 218 may be performed as part of a resampling process where the sample rate is converted to 2*(F2−F1) (e.g., to 2*(14.4 Hz−6.4 Hz=16 kHz)).

A switch 220 outputs one of the signals 217, 219 to be processed at an adaptive whitening and scaling module 222 according to the mode of operation, and an output of the adaptive whitening and scaling module is provided to a first input of a combiner 240, such as an adder. A second input of the combiner 240 receives a signal resulting from an output of a random noise generator 230 that has been processed according to a noise envelope module 232 (e.g., a modulator) and a scaling module 234. The combiner 240 generates a high-band excitation signal 241, such as the high-band excitation signal 161 of FIG. 1.

The input signal 201 that has an effective bandwidth in the frequency range between 0 Hz and F Hz may also be processed at a baseband signal generation path. For example, the input signal 201 may be spectrally flipped at a spectral flip module 242 to generate a flipped signal 243. The flipped signal 243 may be bandpass filtered at a filter 244 to generate a bandpass signal 245 having removed or reduced signal components outside the frequency range from (F−F2) Hz to (F−F1) Hz (e.g., from 1.6 kHz to 9.6 kHz).

In a particular aspect, the filter 244 determines a signal characteristic of an upper frequency range of the high-band portion of the input signal 201. As an illustrative non-limiting example, the filter 244 may determine a long-term average of a high-band signal floor based on filter outputs corresponding to the 12 kHz-16 kHz frequency range, as described with reference to FIG. 1. FIG. 3 illustrates examples of such band-limited signals (denoted 1-7). The linear prediction coefficients (LPCs) estimation of these band limited signals pose quantization and stability issues that lead to artifacts in the high band. For example, if a 32 kHz sampled input signal is band limited to 10 kHz (i.e., there is very limited energy above 10 kHz and up to Nyquist) and the high band is encoding from 8-16 kHz or 6.4-14.4 kHz, then the band limited spectral content from 8-10 kHz may cause stability issues in high band LPC estimation. In particular, the LP coefficients may saturate due to loss in precision when represented in a desired fixed point precision Q-format. In such scenarios, a lower prediction order may be used for the LP analysis (e.g., use LPC order=2 or 4 instead of 10). This reduction of the LPC order for LP analysis to limit the saturation and stability issues can be performed based on the LP gain or the energy of the LP synthesis filter. If the LP gain is higher than a particular threshold, then the LPC order can be adjusted to a lower value. The energy of LP synthesis filter is given by |1/A(z)|^2, where A(z) is the LP analysis filter. A typical LP gain value of 64 corresponding to 48 dB is a good indicator to check for the high LP gains in these band limited scenarios and control the prediction order to avoid the saturation issues in LPC estimation.

The bandpass signal 245 may be downmixed at a downmixer 246 to generate the high-band "target" signal 247 having an effective signal bandwidth in the frequency range from 0 Hz to (F2−F1) Hz (e.g., from 0 Hz to 8 kHz). The high-band target signal 247 is a baseband signal corresponding to the first frequency range.

Parameters representing the modifications to the high-band excitation signal 241 so that it represents the high-band target signal 247 may be extracted and transmitted to the decoder. To illustrate, the high-band target signal 247 may be processed by an LP analysis module 248 to generate LPCs that are converted to LSPs at a LPC-to-LSP converter 250 and quantized at a quantization module 252. The quantization module 252 may generate LSP quantization indices to be sent to the decoder, such as in the high-band side information 172 of FIG. 1.

The LPCs may be used to configure a synthesis filter 260 that receives the high-band excitation signal 241 as an input and generates a synthesized high-band signal 261 as an output. The synthesized high-band signal 261 is compared to the high-band target signal 247 (e.g., energies of the signals 261 and 247 may be compared at each sub-frame of the respective signals) at a temporal envelope estimation module 262 to generate gain information 263, such as gain shape parameter values. The gain information 263 is provided to a quantization module 264 to generate quantized gain information indices to be sent to the decoder, such as in the high-band side information 172 of FIG. 1.

As described above, a lower prediction order may be used for the LP analysis (e.g., use LPC order=2 or 4 instead of 10) if the LP gain is higher than a particular threshold to reduce saturation. To illustrate, the LP analysis module 248 may operate in accordance with the following pseudocode:

```
{
    float energy, lpc_shb1[M+1];
    /*extend the super-high-band LPCs (lpc_shb) to a 16th order gain
        calculation */
    /*initialize a temporary super-high-band LPC vector (lpc_shb1)
        with 0 values */
    set_f(lpc_shb1, 0, M+1);
    /*copy super-high-band LPCs that are in lpc_shb to lpc_shb1 */
    mvr2r(lpc_shb, lpc_shb1, LPC_SHB_ORDER + 1);
    /*estimate the LP gain */
    /*enr_1_Az outputs impulse response energy (enerG)
        corresponding to LP gain based on LPCs and sub-frame size */
    enerG = enr_1_Az(lpc_shb1, 2*L_SUBRF);
    /*if the LP gain is greater than a threshold, avoid saturation.
        The function 'is_numeric_float' is used to check for
        infinity enerG */
    if(enerG > 64 || !(is_numeric_float(enerG)))
    {
        /*re-initialize lpc_shb with 0 values */
        set_f(lpc_shb, 0, LPC_SHB_ORDER+1);
        /*populate lpc_shb with new LPCs for LP order =2 based on a
            vector of autocorrelations (R) and a prediction error
            energy (ervec) using a Levinson-Durbin recursion
            operation */
        lev_dur(lpc_shb, R, 2, ervec);
    }
}
```

Based on the pseudocode, the LP analysis module 248 may determine an LP gain based on an LP gain operation that uses a first value for an LP order. For example, the LP analysis module 248 may estimate the LP gain (e.g., "enerG") using the function 'ener_1_Az'. The function may use a $16^{th}$ order filter (e.g., a sixteenth order gain calculation) to estimate the LP gain. The LP analysis module 248 may also compare the LP gain to a threshold. According to the pseudocode, the threshold has a numerical value of 64. However, it should be understood that the threshold in the pseudocode is merely used as a non-limiting example and other numerical values may be used as the threshold. The LP analysis module 248 may also determine whether the energy level ("enerG") exceeds a limit. For example, the LP analysis module 248 may determine whether the energy level is "infinite" using the function 'is_numeric_float'. If the LP analysis module 248 determines that the energy level (e.g., the LP gain) satisfies the threshold (e.g., is greater than the threshold) or exceeds the limit, or both, the LP analysis module 248 may reduce the LP order from the first value (e.g., 16) to a second value (e.g., 2 or 4) to reduce a likelihood of LPC saturation.

In a particular aspect, the temporal envelope estimation module 262 may adjust values of the gain shape parameter when the signal characteristic determined by the filter 244 satisfies a threshold (e.g., when the signal characteristic indicates that the input signal 201 has little or no content in the upper frequency range of the high-band portion). When encoding such signals, wide swings in the values of the gain shape parameter occur from frame to frame and/or from sub-frame to sub-frame, resulting in audible artifacts in a reconstructed audio signal. For example, as circled in FIG. 3, high-band artifacts may be present in a reconstructed audio signal. The techniques of the present invention may enable reducing or eliminating the presence of such artifacts by selectively adjusting gain shape parameter values when the input signal 201 has little or no content in the high-band portion, or at least an upper frequency region thereof.

As described with respect to the first path, in the first mode of operation the high-band excitation signal 241 generation path includes a downmix operation to generate the signal 217. This downmix operation can be complex if implemented through Hilbert transformers. An alternate implementation may be based on quadrature mirror filters (QMFs). In the second mode of operation, the downmix operation is not included in high-band excitation signal 241 generation path. This results in a mismatch between the high-band excitation signal 241 and the high-band target signal 247. It will be appreciated that generating the high-band excitation signal 241 according to the second mode (e.g., using the filter 218) may bypass the pole-zero filter 214 and the downmixer 216 and reduce complex and computationally expensive operations associated with pole-zero filtering and the down-mixer. Although FIG. 2 describes the first path (including the filter 214 and the downmixer 216) and the second path (including the filter 218) as being associated with distinct operation modes of the encoder 200, in other aspects, the encoder 200 may be configured to operate in the second mode without being configurable to also operate in the first mode (e.g., the encoder 200 may omit the switch 212, the filter 214, the downmixer 216, and the switch 220, having the input of the filter 218 coupled to receive the flipped signal 211 and having the signal 219 provided to the input of the adaptive whitening and scaling module 222).

FIG. 4 depicts a particular aspect of a decoder 400 that can be used to decode an encoded audio signal, such as an encoded audio signal generated by the system 100 of FIG. 1 or the encoder 200 of FIG. 2.

The decoder 400 includes a low-band decoder 404, such as an ACELP core decoder 404, that receives an encoded audio signal 401. The encoded audio signal 401 is an encoded version of an audio signal, such as the input signal 201 of FIG. 2, and includes first data 402 (e.g., a low-band excitation signal 205 and quantized LSP indices) corresponding to a low-band portion of the audio signal and second data 403 (e.g., gain envelope data 463 and quantized LSP indices 461) corresponding to a high-band portion of the audio signal. In a particular aspect, the gain envelope data 463 includes gain shape parameter values that are selectively adjusted to limit variability/dynamic range when an input signal (e.g., the input signal 201) has little or no content in high-band portion (or an upper-frequency region thereof).

The low-band decoder 404 generates a synthesized low-band decoded signal 471. High-band signal synthesis includes providing the low-band excitation signal 205 of FIG. 2 (or a representation of the low-band excitation signal 205, such as a quantized version of the low-band excitation signal 205 received from an encoder) to the upsampler 206 of FIG. 2. High-band synthesis includes generating the high-band excitation signal 241 using the upsampler 206, the non-linear transformation module 208, the spectral flip module 210, the filter 214 and the downmixer 216 (in a first mode of operation) or the filter 218 (in a second mode of operation) as controlled by the switches 212 and 220, and the adaptive whitening and scaling module 222 to provide a first input to the combiner 240 of FIG. 2. A second input to the combiner is generated by an output of the random noise generator 230 processed by the noise envelope module 232 and scaled at the scaling module 234 of FIG. 2.

The synthesis filter 260 of FIG. 2 may be configured in the decoder 400 according to LSP quantization indices received from an encoder, such as output by the quantization module 252 of the encoder 200 of FIG. 2, and processes the excitation signal 241 output by the combiner 240 to generate a synthesized signal. The synthesized signal is provided to a temporal envelope application module 462 that is configured to apply one or more gains, such as gain shape parameter values (e.g., according to gain envelope indices output from the quantization module 264 of the encoder 200 of FIG. 2) to generate an adjusted signal.

High-band synthesis continues with processing by an mixer 464 configured to upmix the adjusted signal from the frequency range of 0 Hz to (F2−F1) Hz to the frequency range of (F−F2) Hz to (F−F1) Hz (e.g., 1.6 kHz to 9.6 kHz). An upmixed signal output by the mixer 464 is upsampled at a sampler 466, and an upsampled output of the sampler 466 is provided to a spectral flip module 468 that may operate as described with respect to the spectral flip module 210 to generate a high-band decoded signal 469 that has a frequency band extending from F1 Hz to F2 Hz.

The low-band decoded signal 471 output by the low-band decoder 404 (from 0 Hz to F1 Hz) and the high-band decoded signal 469 output from the spectral flip module 468 (from F1 Hz to F2 Hz) are provided to a synthesis filter bank 470. The synthesis filter bank 470 generates a synthesized audio signal 473, such as a synthesized version of the audio signal 201 of FIG. 2, based on a combination of the low-band decoded signal 471 and the high-band decoded signal 469, and having a frequency range from 0 Hz to F2 Hz.

As described with respect to FIG. 2, generating the high-band excitation signal 241 according to the second mode (e.g., using the filter 218) may bypass the pole-zero filter 214 and the downmixer 216 and reduce complex and computationally expensive operations associated with pole-zero filtering and the downmixer. Although FIG. 4 describes the first path (including the filter 214 and the downmixer 216) and the second path (including the filter 218) as being associated with distinct operation modes of the decoder 400, in other aspects, the decoder 400 may be configured to operate in the second mode without being configurable to also operate in the first mode (e.g., the decoder 400 may omit the switch 212, the filter 214, the downmixer 216, and the switch 220, having the input of the filter 218 coupled to receive the flipped signal 211 and having the signal 219 provided to the input of the adaptive whitening and scaling module 222).

Referring to FIG. 5A, a particular aspect of a method 500 of adjusting a temporal gain parameter based on a high-band signal characteristic is shown. In an illustrative aspect, the method 500 may be performed by the system 100 of FIG. 1 or the encoder 200 of FIG. 2.

The method 500 may include determining whether a signal characteristic of an upper frequency range of a high-band portion of an audio signal satisfies a threshold, at 502. For example, in FIG. 1, the gain adjuster 162 may determine whether the signal characteristic 126 satisfies the threshold 165.

Advancing to 504, the method 500 may generate a high-band excitation signal corresponding to the high-band portion. The method 500 may further generate a synthesized high-band portion based on the high-band excitation signal, at 506. For example, in FIG. 1, the high-band excitation generator 160 may generate the high-band excitation signal 161 and the synthesis module 164 may generate a synthesized high-band portion based on the high-band excitation signal 161.

Continuing to 508, the method 500 may determine a value of a temporal gain parameter (e.g., gain shape) based on a comparison of the synthesized high-band portion to the high-band portion. The method 500 may also include determining whether the signal characteristic satisfies a threshold, at 510. When the signal characteristic satisfies the threshold, the method 500 may include adjusting the value of the temporal gain parameter at 512. Adjusting the value of the temporal gain parameter may limit a variability of the temporal gain parameter. For example, in FIG. 1, the gain adjuster 162 may adjust a value of the gain shape parameter when the high-band signal characteristic 126 satisfies the threshold 165 (e.g., the high-band signal characteristic 126 indicates that the audio signal 102 has little or no content in a high-band portion (or at least an upper frequency region thereof)). In an illustrative aspect, adjusting the value of the gain shape parameter includes computing a second value of the gain shape parameter based on a sum of a normalized constant (e.g., 0.315) and a particular percentage (e.g., 10%) of a first value of the gain shape parameter, as shown in the pseudocode described with reference to FIG. 1

When the signal characteristic does not satisfy the threshold, the method 500 may include using the unadjusted value of the temporal gain parameter, at 514. For example, in FIG. 1, when the audio signal 102 includes sufficient content the high-band portion (or at least an upper frequency region thereof), the gain adjuster 162 may refrain from limiting variability of the gain shape parameter value(s).

In particular aspects, the method 500 of FIG. 5A may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 500 of FIG. 5A can be performed by a processor that executes instructions, as described with respect to FIG. 6.

Referring to FIG. 5B, a particular aspect of a method 520 of calculating a high-band signal characteristic is shown. In an illustrative aspect, the method 520 may be performed by the system 100 of FIG. 1 or the encoder 200 of FIG. 2.

The method 520 includes generating a spectrally flipped version of an audio signal via performing a spectrum flipping operation on the audio signal to process a high-band portion of the audio signal at baseband, at 522. For example, referring to FIG. 2, the spectral flip module 242 may generate the flipped signal 243 (e.g., a spectrally flipped version of the input signal 201) by performing a spectrum flipping operation on the input signal 201. Spectrally flipping the input signal 201 may enable processing of the upper frequency range of the high-band portion (e.g., 12-16 kHz portion) of the input signal 201 at baseband.

A sum of energy values may be calculated based on the spectrally flipped version of the audio signal, at 524. For example, referring to FIG. 1, the pre-processing module 110 may perform a long-term averaging operation on the sum of energy values. The energy values may correspond to QMF outputs corresponding to the upper frequency range of the high-band portion of the input signal 201. The sum of energy values may be indicative of the high-band signal characteristic 126.

The method 520 of FIG. 5B may reduce artifacts generated during encoding/decoding of a band-limited audio signal. For example, the long-term average of the sum of energy values may be indicative of the high-band signal characteristic 126. If the high-band signal characteristic 126 satisfies a threshold (e.g., the signal characteristic indicates that the audio signal is band-limited and has little or no high-band content), an encoder may adjust the value of the gain shape parameter to limit variability (e.g., a limited dynamic range) of the gain shape parameter. Limiting the variability of the gain shape parameter may reduce artifacts generated during encoding/decoding of the band-limited audio signal.

In particular aspects, the method 520 of FIG. 5B may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 520 of FIG. 5B can be performed by a processor that executes instructions, as described with respect to FIG. 6.

Referring to FIG. 5C, a particular aspect of a method 540 of adjusting LPCs of an encoder is shown. In an illustrative aspect, the method 540 may be performed by the system 100 of FIG. 1 or the LP analysis module 248 of FIG. 2. According to one implementation, the LP analysis module 248 may operate in accordance with the corresponding pseudocode described above to perform the method 540.

The method 540 includes determining, at an encoder, a linear prediction (LP) gain based on an LP gain operation that uses a first value for an LP order, at 542. The LP gain may be associated with an energy level of an LP synthesis filter. For example, referring to FIG. 2, the LP analysis module 248 may determine an LP gain based on an LP gain calculation that uses a first value for an LP order. According to one implementation, the first value corresponds to a sixteenth order filter. The LP gain may be associated with an energy level of the synthesis filter 260. For example, the energy level may correspond to an impulse response energy level that is based on an audio frame size of an audio frame and based on a number of LPCs generated for the audio frame. The synthesis filter 260 (e.g., the LP synthesis filter) may be responsive to the high-band excitation signal 241 generated from a nonlinear extension of a low-band excitation signal (e.g., generated from the bandwidth-extended signal 209).

The LP gain may be compared to a threshold, at 544. For example, referring to FIG. 2, the LP analysis module 248 may compare the LP gain to a threshold. The LP order may be reduced from the first value to a second value if the LP gain satisfies the threshold, at 546. For example, referring to FIG. 2, the LP analysis module 248 may reduce the LP order from the first value to a second value if the LP gain satisfies (e.g., is above) the threshold. According to one implementation, the second value corresponds to a second order filter. According to another implementation, the second value corresponds to a fourth order filter.

The method 540 may also include determining whether the energy level exceeds a limit. For example, referring to FIG. 2, the LP analysis module 248 may determine whether the energy level of the synthesis filter 260 exceeds a limit (e.g., an "infinite" limit that may cause the energy value to be interpreted as having an incorrect numerical value). The LP order may be reduced from the first value to the second value in response to the energy level of the synthesis filter 260 exceeding the limit.

In particular aspects, the method 540 of FIG. 5C may be implemented via hardware (e.g., a FPGA device, an ASIC, etc.) of a processing unit, such as a CPU, a DSP, or a controller, via a firmware device, or any combination thereof. As an example, the method 540 of FIG. 5C can be performed by a processor that executes instructions, as described with respect to FIG. 6.

Referring to FIG. 6, a block diagram of a particular illustrative aspect of a device (e.g., a wireless communication device) is depicted and generally designated 600. In various aspects, the device 600 may have fewer or more components than illustrated in FIG. 6. In an illustrative aspect, the device 600 may correspond to one or more components of one or more systems, apparatus, or devices described with reference to FIGS. 1,2, and 4. In an illustrative aspect, the device 600 may operate according to one or more methods, described herein, such as all or a portion of the method 500 of FIG. 5A, the method 520 of FIG. 5B, and/or the method 540 of FIG. 5C.

In a particular aspect, the device 600 includes a processor 606 (e.g., a central processing unit (CPU)). The device 600 may include one or more additional processors 610 (e.g., one or more digital signal processors (DSPs)). The processors 610 may include a speech and music coder-decoder (CODEC) 608 and an echo canceller 612. The speech and music CODEC 608 may include a vocoder encoder 636, a vocoder decoder 638, or both.

In a particular aspect, the vocoder encoder 636 may include the system 100 of FIG. 1 or the encoder 200 of FIG. 2. The vocoder encoder 636 may include a gain shape adjuster 662 configured to selectively adjust temporal gain information (e.g., gain shape parameter value(s)) based on a high-band signal characteristic (e.g., when the high-band signal characteristic indicates that an input audio signal has little or no content in a upper frequency range of a high-band portion).

The vocoder decoder 638 may include the decoder 400 of FIG. 4. For example, the vocoder decoder 638 may be configured to perform signal reconstruction 672 based on adjusted gain shape parameter values. Although the speech and music CODEC 608 is illustrated as a component of the processors 610, in other aspects one or more components of the speech and music CODEC 608 may be included in the processor 606, the CODEC 634, another processing component, or a combination thereof.

The device 600 may include a memory 632 and a wireless controller 640 coupled to an antenna 642 via transceiver 650. The device 600 may include a display 628 coupled to a display controller 626. A speaker 648, a microphone 646, or both may be coupled to the CODEC 634. The CODEC 634 may include a digital-to-analog converter (DAC) 602 and an analog-to-digital converter (ADC) 604.

In a particular aspect, the CODEC 634 may receive analog signals from the microphone 646, convert the analog signals to digital signals using the analog-to-digital converter 604, and provide the digital signals to the speech and music CODEC 608, such as in a pulse code modulation (PCM) format. The speech and music CODEC 608 may process the digital signals. In a particular aspect, the speech and music CODEC 608 may provide digital signals to the CODEC 634. The CODEC 634 may convert the digital signals to analog signals using the digital-to-analog converter 602 and may provide the analog signals to the speaker 648.

The memory 632 may include instructions 656 executable by the processor 606, the processors 610, the CODEC 634, another processing unit of the device 600, or a combination thereof, to perform methods and processes disclosed herein, such as the methods of FIGS. 5A-5B. One or more components of the systems of FIG. 1, 2, or 4 may be implemented via dedicated hardware (e.g., circuitry), by a processor executing instructions to perform one or more tasks, or a combination thereof. As an example, the memory 632 or one or more components of the processor 606, the processors 610, and/or the CODEC 634 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 656) that, when executed by a computer (e.g., a processor in the CODEC 634, the processor 606, and/or the processors 610), may cause the computer to perform at least a portion of the methods of FIGS. 5A-5B. As an example, the memory 632 or the one or more components of the processor 606, the processors 610, the CODEC 634 may be a non-transitory computer-readable medium that includes instructions (e.g., the instructions 656) that, when executed by a computer (e.g., a processor in the CODEC 634, the processor 606, and/or the processors 610), cause the computer perform at least a portion of the methods of FIGS. 5A-5B.

In a particular aspect, the device 600 may be included in a system-in-package or system-on-chip device 622, such as a mobile station modem (MSM). In a particular aspect, the processor 606, the processors 610, the display controller 626, the memory 632, the CODEC 634, the wireless controller 640, and the transceiver 650 are included in a system-in-package or the system-on-chip device 622. In a particular aspect, an input device 630, such as a touchscreen and/or keypad, and a power supply 644 are coupled to the system-on-chip device 622. Moreover, in a particular aspect, as illustrated in FIG. 6, the display 628, the input device 630, the speaker 648, the microphone 646, the antenna 642, and the power supply 644 are external to the system-on-chip device 622. However, each of the display 628, the input device 630, the speaker 648, the microphone 646, the antenna 642, and the power supply 644 can be coupled to a component of the system-on-chip device 622, such as an interface or a controller. In an illustrative aspect, the device 600 corresponds to a mobile communication device, a smartphone, a cellular phone, a laptop computer, a computer, a tablet computer, a personal digital assistant, a display device, a television, a gaming console, a music player, a radio, a digital video player, an optical disc player, a tuner, a camera, a navigation device, a decoder system, an encoder system, or any combination thereof.

In an illustrative aspect, the processors 610 may be operable to perform signal encoding and decoding operations in accordance with the described techniques. For example, the microphone 646 may capture an audio signal. The ADC 604 may convert the captured audio signal from an analog waveform into a digital waveform that includes digital audio samples. The processors 610 may process the digital audio samples. The echo canceller 612 may reduce an echo that may have been created by an output of the speaker 648 entering the microphone 646.

The vocoder encoder 636 may compress digital audio samples corresponding to a processed speech signal and may form a transmit packet (e.g. a representation of the compressed bits of the digital audio samples). For example, the transmit packet may correspond to at least a portion of the bit stream 192 of FIG. 1. The transmit packet may be stored in the memory 632. The transceiver 650 may modulate some form of the transmit packet (e.g., other information may be appended to the transmit packet) and may transmit the modulated data via the antenna 642.

As a further example, the antenna 642 may receive incoming packets that include a receive packet. The receive packet may be sent by another device via a network. For example, the receive packet may correspond to at least a portion of the bit stream received at the ACELP core decoder 404 of FIG. 4. The vocoder decoder 638 may decompress and decode the receive packet to generate reconstructed audio samples (e.g., corresponding to the synthesized audio signal 473). The echo canceller 612 may remove echo from the reconstructed audio samples. The DAC 602 may convert an output of the vocoder decoder 638 from a digital waveform to an analog waveform and may provide the converted waveform to the speaker 648 for output.

Those of skill would further appreciate that the various illustrative logical blocks, configurations, modules, circuits, and algorithm steps described in connection with the aspects disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A method of audio coding by adjusting linear prediction coefficients (LPCs) of an encoder, the method comprising:

determining, at the encoder, a linear prediction (LP) gain based on an LP gain operation that uses a first value for an LP order, the LP gain associated with an energy level of an LP synthesis filter;

comparing the LP gain to a threshold;

reducing the LP order from the first value to a second value if the LP gain is greater than the threshold;

transforming the LPCs to line spectral pairs (LSPs), the LPCs based on the LP order; and transmitting the LSPs as part of a bit-stream from the encoder to a receiver.

2. The method of claim 1, wherein the LP synthesis filter is responsive to a high-band excitation signal generated from a harmonic extension of a low-band excitation signal.

3. The method of claim 1, wherein the energy level corresponds to an impulse response energy and is based on an audio frame size of an audio frame and a number of LPCs generated for the audio frame.

4. The method of claim 1, wherein the first value corresponds to a tenth order filter, and wherein the second value corresponds to a second order filter or a fourth order filter.

5. The method of claim 1, wherein reducing the LP order from the first value to the second value is performed within a device that comprises a mobile communication device.

6. The method of claim 1, wherein reducing the LP order from the first value to the second value is performed within a device that comprises a base station.

7. An apparatus comprising:

an encoder; and a memory storing instructions executable by the encoder to perform audio coding operations comprising:

determining a linear prediction (LP) gain based on an LP gain operation that uses a first value for an LP order, the LP gain associated with an energy level of an LP synthesis filter;

comparing the LP gain to a threshold;

reducing the LP order from the first value to a second value if the LP gain is greater than the threshold; and transforming the LPCs to line spectral pairs (LSPs), the LPCs based on the LP order; and a transmitter operable to transmit the LSPs as part of a bit-stream to a receiver.

8. The apparatus of claim 7, wherein the energy level corresponds to an impulse response energy and is based on an audio frame size of an audio frame and a number of LPCs generated for the audio frame.

9. The apparatus of claim 7, wherein the first value corresponds to a tenth order filter, and wherein the second value corresponds to a second order filter or a fourth order filter.

10. The apparatus of claim 7, further comprising:

an antenna; and a transmitter coupled to the antenna and configured to transmit an encoded audio signal.

11. The apparatus of claim 10, wherein the transmitter and the encoder are integrated into a mobile communication device.

12. The apparatus of claim 10, wherein the transmitter and the encoder are integrated into a base station.

13. A non-transitory computer-readable medium comprising instructions for adjusting linear prediction coefficients (LPCs) of an encoder, the instructions, when executed by the encoder, cause the encoder to perform audio coding operations comprising:

determining a linear prediction (LP) gain based on an LP gain operation that uses a first value for an LP order, the LP gain associated with an energy level of an LP synthesis filter;

comparing the LP gain to a threshold;

reducing the LP order from the first value to a second value if the LP gain is greater than the threshold;

transforming the LPCs to line spectral pairs (LSPs), the LPCs based on the LP order; and initiating transmission of the LSPs as part of a bit-stream from the encoder to a receiver.

14. The non-transitory computer-readable medium of claim 13, wherein the energy level corresponds to an impulse response energy and is based on an audio frame size of an audio frame and a number of LPCs generated for the audio frame.

15. The non-transitory computer-readable medium of claim 13, wherein the first value corresponds to a tenth order filter, and wherein the second value corresponds to a second order filter or a fourth order filter.

16. An apparatus for performing audio coding operations, the apparatus comprising:

means for determining a linear prediction (LP) gain based on an LP gain operation that uses a first value for an LP order, the LP gain associated with an energy level of an LP synthesis filter;

means for comparing the LP gain to a threshold;

means for reducing the LP order from the first value to a second value if the LP gain is greater than the threshold;

means for transforming the LPCs to line spectral pairs (LSPs), the LPCs based on the LP order; and means for transmitting the LSPs as part of a bit-stream from the encoder to a receiver.

17. The apparatus of claim 16, wherein the energy level corresponds to an impulse response energy and is based on an audio frame size of an audio frame and a number of LPCs generated for the audio frame.

18. The apparatus of claim 16, wherein the means for determining the LP gain, the means for comparing the LP gain to the threshold, and the means for reducing the LP order are integrated into a mobile communication device.

19. The apparatus of claim 16, wherein the means for determining the LP gain, the means for comparing the LP gain to the threshold, and the means for reducing the LP order are integrated into a base station.

* * * * *